US005983809A

United States Patent [19]

Vatsky

[11] Patent Number: 5,983,809

[45] **Date of Patent: *Nov. 16, 1999**

[54] BURNER ASSEMBLY WITH LOW EROSION INLET ELBOW

[75] Inventor: Joel Vatsky, West Orange, N.J.

[73] Assignee: Foster Wheeler Energy International, Inc., Clinton, N.J.

[ * ] Notice: Under 35 U.S.C. 154(b), the term of this patent shall be extended for 38 days.

[21] Appl. No.: 08/595,967

[22] Filed: Feb. 6, 1996

[51] Int. Cl.[6] ..... F23C 1/10; F23C 7/00; F23D 1/00; F23M 9/00

[52] U.S. Cl. ..... 110/261; 110/263; 431/187; 431/188

[58] Field of Search ..... 110/261, 263, 110/265; 431/186, 187, 188

[56] References Cited

U.S. PATENT DOCUMENTS

| | | | |
|---|---|---|---|
| 1,995,934 | 3/1935 | Mangold . | |
| 2,271,587 | 2/1942 | Haynes . | |
| 2,480,547 | 8/1949 | Caracristi . | |
| 2,838,103 | 4/1958 | Voorheis . | |
| 2,889,871 | 3/1959 | Voorheis . | |
| 3,391,981 | 7/1968 | Voorheis . | |
| 3,576,384 | 4/1971 | Peczeli et al. | 431/353 |
| 4,130,300 | 12/1978 | Sheridan . | |
| 4,387,914 | 6/1983 | Paulson et al. . | |
| 4,400,151 | 8/1983 | Vatsky . | |
| 4,606,556 | 8/1986 | Metzger . | |
| 4,641,864 | 2/1987 | Heine et al. . | |
| 4,684,155 | 8/1987 | Davis . | |
| 4,865,353 | 9/1989 | Osborne . | |
| 4,995,645 | 2/1991 | Pausch . | |
| 5,016,923 | 5/1991 | Adamaitis . | |
| 5,024,466 | 6/1991 | Brotz . | |
| 5,060,984 | 10/1991 | Hess . | |
| 5,347,937 | 9/1994 | Vatsky . | |

*Primary Examiner*—Ira S. Lazarus
*Assistant Examiner*—Ljiljana V. Ciric
*Attorney, Agent, or Firm*—Haynes and Boone, L.L.P.

[57] ABSTRACT

A burner assembly in which an inlet is provided for receiving a mixture of particulate fuel and air, an outlet extending at an angle to the axis of said inlet. A passage connects the inlet and the outlet for passing a portion of the mixture directly from the inlet to the outlet, and a chamber communicates with the inlet for receiving a second portion of the mixture. The chamber is constructed and arranged to swirl the second mixture portion and direct it towards the passage for passing to the outlet. As a result, particle fracture and friction losses are minimized and the burner assembly can operate at relatively low pressures.

A burner section communicates with the inlet section and includes an inlet for receiving the fuel-air mixture from the outlet of the inlet section, and an outlet for discharging the mixture into a furnace. A portion of the fuel-air mixture is divided into a plurality of flow streams in the burner section which discharge from the burner section in a manner to form a plurality of flame patterns. The remaining portion of the mixture passes through an annular passage in the burner section for discharge in an annular flow pattern and the flames produced as a result of the combustion of the fuel are stabilized.

4 Claims, 1 Drawing Sheet

BURNER ASSEMBLY WITH LOW EROSION INLET ELBOW

BACKGROUND OF THE INVENTION

This invention relates to a burner assembly for discharging a mixture of particulate fuel and air to a furnace, and, more particularly, to such an assembly having an inlet elbow for creating a low pressure and an improved fuel/air distribution with a minimum of particle fracturing and wall erosion.

Many burner assemblies that introduce fuel and air into a furnace have a tangential inlet, that is, a duct, or the like, that receives the fuel/air mixture and introduces it tangentially relative to the cylindrical body of the burner. This enables the relatively heavy fuel particles to migrate radially outwardly towards the burner wall due to centrifugal forces, and the relatively light air to tend to pass through the center of the burner, which aids the burner designer in creating optimum combustion conditions at the burner outlet.

However, problems exist in the use of these tangential flow patterns at the burner inlet. For example, if the turn from the inlet duct into the burner body is relatively sharp, the particulate material impinges upon an area of the duct directly opposite its inlet and rapidly erodes the wall in this area as well as cause the particles to fracture and lose energy by friction. Also, the distribution of the fuel/air mixture is less than uniform and the long, curved tangentially-extending pipes are difficult and expensive to install and take up a great deal of space.

Accordingly, U.S. Pat. Nos. 4,387,914 and 5,060,984 each disclose an specially designed elbow designed to receive a fluent material to prevent erosion of the inner surface of the elbow as well as fracture of the fuel particles and frictional losses. However, these elbows are unsuited for use in a combustion system utilizing one or more burners for receiving a mixture of air and fuel, such as coal, and combusting the fuel for several reasons. For example, the design of the elbows disclosed in the above-cited patents is such that the fluent material being processed continuously passes through, and is discharged from, the elbow in a relatively large, single flow stream. As a result, the pressure drop across the elbow is relatively high which, if used in a combustion system, would require relatively high fan capacities and a general increase in the power requirements of the system. Also, the single, relatively large, flow stream of the fuel-air mixture and its associated flame pattern in a combustion system would result in relatively uneven fuel distribution, relatively low flame radiation, relatively high average flame temperature, less than complete combustion and a relatively long residence time of the gas components within the flame, all of which are undesirable from an efficiency standpoint.

Therefore what is needed is a burner assembly utilizing the elbow disclosed in the above-cited patents while eliminating the problems when the elbow is utilized with a burner in a combustion system.

SUMMARY OF THE INVENTION

Accordingly, the burner assembly of the present invention includes an elbow that minimizes erosion of the inner walls of the elbow, fracture of the particulate fuel material and frictional losses, while providing increased operational efficiencies. To this end, the burner assembly of the present invention includes an inlet section having an inlet for receiving a mixture of particulate fuel and air, an outlet extending at an angle to the axis of said inlet. A passage connects the inlet and the outlet for passing a portion of the mixture directly from the inlet to the outlet, and a chamber communicates with the inlet for receiving a second portion of the mixture. The chamber is constructed and arranged to swirl the second mixture portion and direct it towards the passage for passing to the outlet. As a result, particle fracture and friction losses are minimized and the burner assembly can operate at relatively low pressures.

A burner section communicates with the inlet section and includes an inlet for receiving the fuel-air mixture from the outlet of the inlet section, and an outlet for discharging the mixture into a furnace. A portion of the fuel-air mixture is divided into a plurality of flow streams in the burner section which discharge from the burner section in a manner to form a plurality of individual, relatively small flames, resulting in a greater flame radiation, lower average flame temperature, and a shorter residence time of the gas components within each flame at a maximum temperature. The flame patterns are stabilized by a helical rib is formed on the inner surface of a wall in the burner section to collect the fuel particles in the fuel-air mixture and by a vane disposed on the outer surface of the burner to direct the secondary air towards the flames. The remaining portion of the mixture passes through an annular passage in the burner section for discharge in an annular flow pattern.

As a result, a uniform distribution of the fuel/aid mixture is achieved in the burner section, combustion efficiency is improved and the formation of nitric oxides is reduced.

DESCRIPTION OF THE PREFERRED EMBODIMENT

Figure 1:
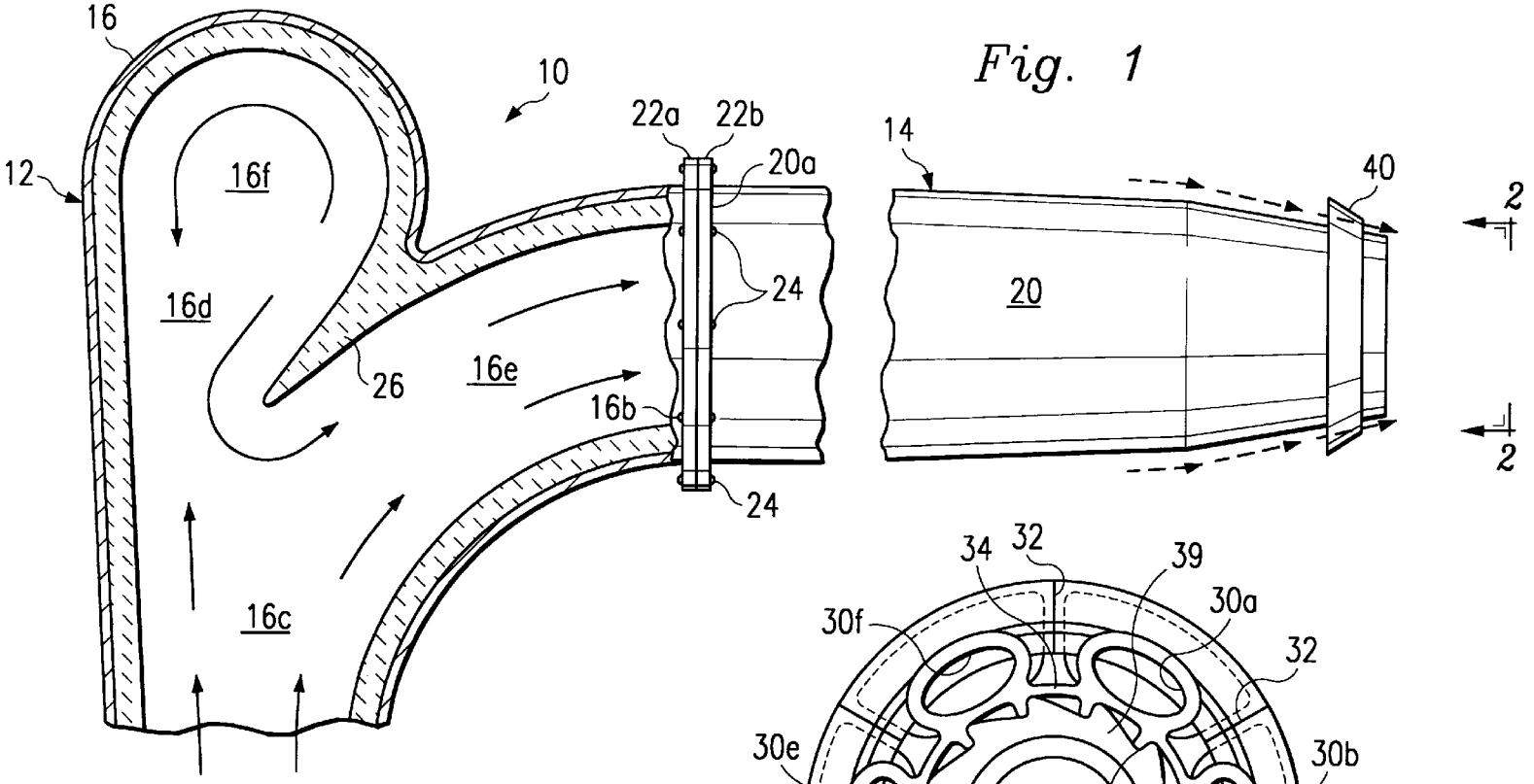
FIG. 1 is a partial section-partial elevation view of the burner assembly of the present invention.

Referring to the drawing, the reference numeral 10 refers, in general, to the burner assembly of the present invention which consists of an inlet section 12 and a burner section 14. The inlet section 12 is formed by a hollow body member 16 formed by refractory lined walls and configured to define an inlet opening 16*a* and an outlet opening 16*b*. The axis of the outlet opening extends at an angle, which for the purposes of example is approximately ninety degrees, to the axis of the inlet opening 16*a*.

The burner section 14 consists of an outer, substantially tubular member 20 having an inlet end 20*a* and a discharge end 20*b* which will be described in detail later. The discharge end portion of the tubular member 20 is slightly tapered as shown.

Two arcuate flanges 22*a* and 22*b* respectively extend from the outer surface of the body member 16 near its outlet opening 16*b* and from the outer surface of the tubular member 20 near its inlet end 20*a*. A series of bolts 24 extend through aligned openings in the flanges 22*a* and 22*b* to connect the inlet section 12 to the burner section 14, with the outlet opening 16*b* of the body member 16 in registry with the inlet end of the tubular member 20.

A passage 16*c* is provided in the body member 16 and extends immediately downstream of the inlet opening 16*a* for receiving a mixture of particulate fuel and air from an external source (not shown). An internal splitter wall 26 is provided in the body member 16 and serves to divide the passage 16*c* into two passages 16*d* and 16*e*, with the passage 16*e* curving towards the outlet opening y 16*b* and the passage 16*d* extending straight to a chamber 16*f* located adjacent the wall 26. Since the configurations of the walls of the body member 16, including wall 26, that define the various passages 16*a*–16*e* and the chamber 16*f* are apparent from the drawing they will not be described in any further detail. The flow of the fuel/air mixture entering the inlet opening 16*a* thus flows in the pattern shown by the solid flow arrows as it passes to the outlet opening 16*b*.

According to features of the present invention the burner section 14 is configured to take full advantage of the arrangement of the body member 16 discussed above. More particularly, and with reference to FIG. 2, a portion of the fuel/air mixture discharging from the burner section 14 is split into a plurality of streams to produce a corresponding number of individual flames upon ignition. To this end, six circumferentially-spaced passages 30*a*–30*f* are formed in the interior of the tubular member 20 for receiving a portion of the mixture passing therethrough and are angularly spaced at sixty degree intervals.

Each passage 30*a*–30*f* is formed by a plurality of elliptical-shaped (in cross section) walls 32 which extend for the complete length of the tapered end portion (FIG. 1) of the tubular member. The walls 32 are configured so that the cross-sectional area of each passage 30*a*–30*f* is gradually reduced in a direction towards the discharge end 20*b* of the member 20. The walls 32 extend from the inner wall of the member 20 and an inner wall 34, circular in cross-section, is located between the walls 32, and therefore the passages 30*a*–30*f*, and the axis of the member 20.

A plurality of ribs 36 are formed on the inner surface of the inner wall 34 to collect the solid fuel particles as the portion of the mixture of fuel particles and air pass through the inner wall. Although not clear from the drawing, it is understood that the ribs 36 extend in a helical pattern which stabilizes the flame on combustion and increases the combustion efficiency.

Figure 2:
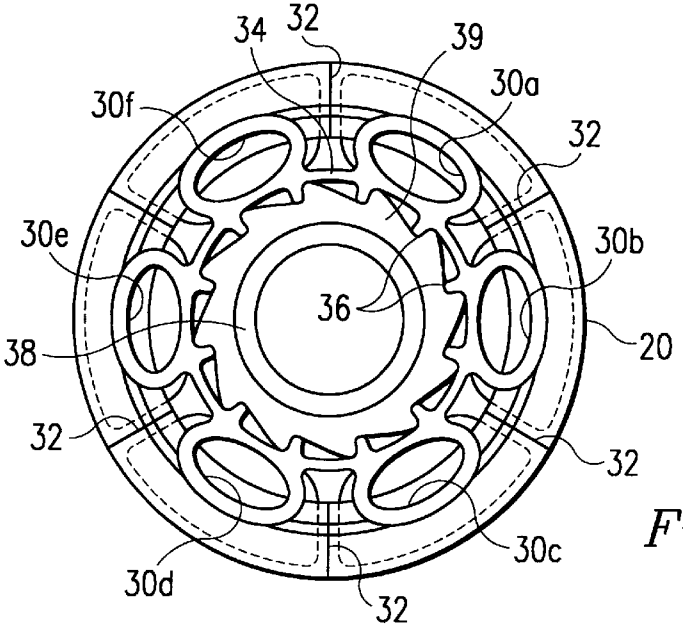
FIG. 2 is an end elevational view taken along the line 2—2 of FIG. 1 with the stabilizer vane of FIG. 1 being omitted for the convenience of presentation.

An inner tubular member 38 is disposed within the inner wall 34 to define an annular passage 39 for receiving and discharging the remaining portion of the fuel/air mixture. The arrangement of FIG. 2 is fully disclosed in detail in U.S. Pat. No. 5,347,937 which is assigned to the assignee of the present invention and the disclosure of which is hereby incorporated by reference.

It is understood that the burner assembly 10 of the present invention will be positioned relative to an opening formed in a furnace wall for discharging the fuel/air mixture passing through the burner assembly into the interior of the furnace for combustion. To this end, a windbox and associated registers and dampers (not shown) are provided adjacent to, or surrounding, the burner assembly 10 for introducing secondary air along the outer surface of the burner assembly as shown by the dashed arrows in FIG. 1, so that the secondary air mixes with, and supports the combustion of, the fuel as it discharges from the outlet 20*b* of the tubular member 20. In this context and according to a feature of the present invention, a frusto-conical vane 40 extends over the tapered end portion of the tubular member 20. The vane 40, which is omitted from FIG. 2 for the convenience of presentation, but is shown in FIG. 1, extends in a spaced relationship to the member 22 to define an annular space therebetween. It is understood that support struts (not shown) extend between, and are affixed to, the outer surface of the tubular member 20 and the inner surface of the vane 40 to support the vane over the member 20 in a slightly spaced relationship to the outer surface of the member.

The vane 40 is tapered radially inwardly in a direction towards the outlet end of the member 20 with its smaller diameter extending downstream from its larger diameter and slightly upstream from the end 20*b* of the tubular member 20. Thus, a portion of the secondary air passing through the passage 44 impinges against the inner wall of the vane 40 which serves to direct the latter portion to and through the annular gap 42 and towards the discharge end 20*b* of the tubular member 22. This air, along with the remaining portion of the secondary air passing adjacent the tubular member 20, mixes with the streams of combusting fuel/air mixture discharging from the member 20 and supplies sufficient oxygen to insure complete combustion of the fuel. The vane 40 increases the stability of the flame and thus increases combustion efficiency.

In operation, a mixture of particulate fuel and air enters the inlet section 12 through the inlet opening 16*a* in the body member 16 and flows to the passage 16*c*. The mixture is split into two streams by the splitter wall 26, with one stream entering, and passing through, the passage 16*e* to the outlet 16*b* for passage into the burner section 14; and with the other stream entering and passing through the passage 16*d* for passing into the chamber 16*f*. The mixture then flows from the outlet opening 16*b* into the burner section 14 and, more particularly, into the inlet end 20*a* of the tubular member 20.

In the tubular member 20, a portion of the mixture enters the passages 30*a*–30*f* to split the mixture into separate streams for discharge from the burner section 14 into the furnace to form six individual flames. The remaining portion of the mixture passes through the annular chamber 39 with the helical ribs 36 functioning to collect the solid fuel particles before the air and particles discharge from the outlet end 20*b* of the member 20.

A portion of the secondary air passing along the outer surface of the tubular member 20 impinges against the inner wall of the vane 40 which serves to direct the latter portion to and through the annular gap between the vane and the outer surface of the tubular member 20 and towards the discharge end 20*b* of the tubular member. This secondary air, along with the remaining portion of the secondary air, mixes with the streams of combusting fuel/air mixture discharging from the tubular member 20 at a location just downstream of its outlet end 20*b* member.

Several advantages result from the burner assembly of the present invention. For example, particle fracture, friction losses and erosion of the inner walls of the inlet section 12 are is minimized. Also, a uniform distribution of the fuel/aid mixture is achieved. Further, the ribs 36 and the vane 40 enables flame shape to be stabilized, and a more gradual and controlled mixing of the secondary air with the mixture of fuel and primary air. Still further, the provision of multiple flame patterns, each of which receives the stabilized secondary air from the vane 40, results in a greater flame radiation, a lower average flame temperature and a shorter residence time of the gas components within the flame at a maximum temperature, all of which contribute to reduce the formation of nitric oxides. Still further, the burner assembly 10 can operate at relatively low pressures yet is simple in construction, easy to install and takes up relatively little space.

It is understood that several variations may be made in the foregoing with departing from the scope of the invention. For example, the body member 16 and the burner section 14 can be formed integrally, and the number discharge streams formed within, and discharged from the burned assembly 10 can be varied.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A burner assembly comprising an inlet section comprising an inlet for receiving a mixture of particulate fuel and air, an outlet extending at an angle to the axis of the inlet, a passage connecting the inlet and the outlet for passing a portion of the mixture directly from the inlet to the outlet, and a chamber communicating with the inlet for receiving a second portion of the mixture, the chamber being constructed and arranged to swirl the second mixture portion and direct it towards the passage for passing to the outlet; and a burner section comprising a tubular member, an inner member disposed in the tubular member for forming an annular passage having an inlet for receiving the mixture from the inlet section and an outlet for discharging the mixture in an annular flow pattern, a plurality of splitters formed in the annular passage for splitting at least a portion of the mixture into a plurality of individual streams which, when discharged from the latter outlet and ignited, form a plurality of flame patterns, a plurality of ribs formed in the annular passage for increasing the stability of the flame produced upon combustion of the fuel, an air source for passing air over the outer surface of the tubular member and towards the latter outlet, and a conical vane disposed on the outer surface of the tubular member for receiving air passing over the outer surface and for directing the air into a combustion-supporting relationship with the fuel in the mixture.

2. The assembly of claim 1 wherein the inlet of the inlet section has a circular cross-section and wherein at least a portion of the chamber is aligned with the latter inlet.

3. The assembly of claim 1 wherein the inlet section further comprises a partition extending between the passage of the inlet section and the chamber for splitting the flow of the mixture into two streams and respectively directing the streams into the latter passage and into the chamber.

4. The assembly of claim 1 wherein the splitters are formed by a plurality of walls and partitions in the interior of the burner section.

* * * * *